United States Patent [19]

Moss et al.

[11] Patent Number: 4,586,803

[45] Date of Patent: May 6, 1986

[54] DEVELOPING DRUM

[75] Inventors: Brian F. Moss, Chelford; Ian B. Pilkington, Prestbury; Richard J. Brent, Bramhall, all of England

[73] Assignee: Ciba-Geigy AG, Basel, Switzerland

[21] Appl. No.: 673,275

[22] Filed: Nov. 20, 1984

[30] Foreign Application Priority Data

Nov. 23, 1983 [GB] United Kingdom ..... 8331265
Oct. 26, 1984 [GB] United Kingdom ..... 8427101

[51] Int. Cl.[4] ..... G03D 13/06

[52] U.S. Cl. ..... 354/313; 354/323; 354/329; 354/337

[58] Field of Search ..... 354/310, 311, 312, 313, 354/314, 316, 323, 329, 330, 331, 337, 341, 335; 414/412

[56] References Cited

U.S. PATENT DOCUMENTS

| | | | |
|---|---|---|---|
| 2,781,708 | 2/1957 | Perlin | 354/311 |
| 3,605,601 | 9/1971 | Okayama et al. | 354/335 |
| 4,001,857 | 1/1977 | Ikechi et al. | 354/313 |
| 4,134,666 | 1/1979 | Kikuchi | 354/313 |
| 4,171,055 | 10/1979 | Lindgren | 414/412 |
| 4,211,481 | 7/1980 | Bernhardt | 354/312 |
| 4,428,658 | 1/1984 | Moore et al. | 354/310 |

FOREIGN PATENT DOCUMENTS 641854 2/1937 Fed. Rep. of Germany ..... 354/313

*Primary Examiner*—A. A. Mathews
*Attorney, Agent, or Firm*—Burns, Doane, Swecker & Mathis

[57] ABSTRACT

Apparatus is described for the processing of a film contained in a cassette. The cassette comprises a substantially cylindrical body formed with a light-tight, longitudinally extending film exit slot, end caps to the body and a spool held between the caps and having the film wound thereon. The apparatus comprises a light-tight enclosure, preferably in the form of a columnar body, provided with means shaped to receive and retain the cassette body and provided with a space sufficiently large to receive from the cassette the spool with the film wound thereon. A plunger is provided for engaging the spool of the cassette and for moving it to force an end cap off the cassette body and to move the spool and the film wound thereon into said space where the film can be treated with processing liquid. The processing liquid may be present in the space or can be introduced into it and drained from it through light-tight channels and/or passages. The plunger may pass through a lid of the enclosure or be fixed to it. Rotation in both directions of the plunger in the apparatus causes the film to wind and unwind in the spool and to be washed evenly with processing liquid.

18 Claims, 12 Drawing Figures

DEVELOPING DRUM

Figure 1:
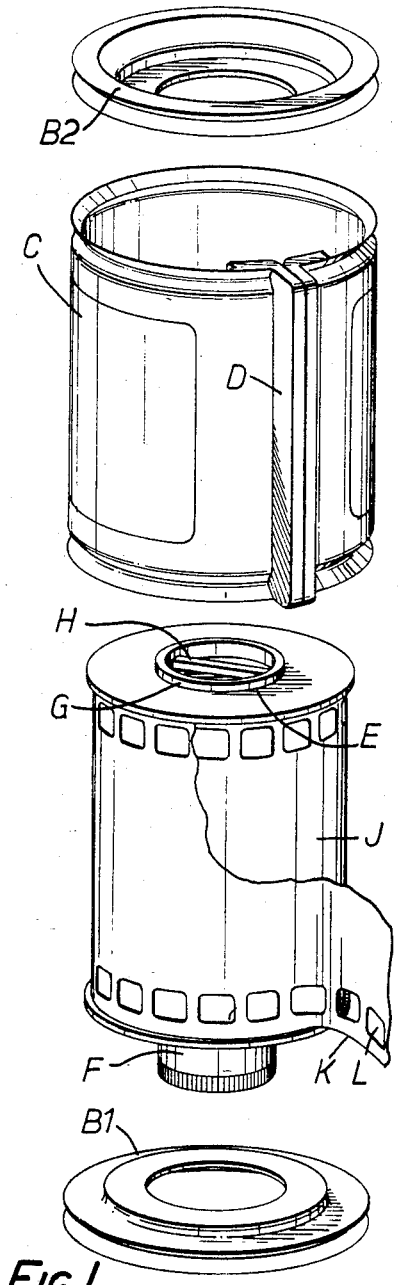

This invention relates to an apparatus for processing exposed lengths of photographic film material.

Most often nowadays, lengths of photographic film are coiled on a spool in a film cassette. After the film has been exposed in a camera, the cassette is removed therefrom and the cassette is opened in the dark. After the film leader has been trimmed, the length of film is would into an open spiral which holds the film length at its edges. After all the film length has been wound into the spiral, usually by hand, the spiral is placed in a light-tight processing drum and a light-tight lid is placed thereon. Thereafter the drum can be taken into the daylight and processing liquid can be poured into the drum and removed therefrom in daylight. After processing is complete the lid is removed from the drum and the film is washed and examined.

However a large number of people do not like operating in the dark and in the modern house it is often difficult to provide an area which is sufficiently light proof to enable a highly light-sensitive film to be taken out of the cassette and wound into the spiral without the risk of fogging the film.

A number of attempts have been made to provide a processing device in which the loaded cassette is placed in full daylight in a processing device and the film is wound from the cassette into a spiral mounted already in the device. However such devices have been found to be difficult to operate, to be very bulky and expensive and often to require a large volume of processing liquid to fill the processing tank portion of the device. Thus wide spread use has not been made of such daylight loading processing tanks. Nevertheless, various daylight processing methods have been described in the past in published patents but none of these has found wide acceptance. For example in U.S. Pat. No. 2,781,708 the film is loaded into a very special type of film holder or cartridge; such a cartridge requires a special camera because this cartridge is not the well known film cassette as used in the majority of 35 mm. cassettes. In U.S. Pat. No. 3,605,601 and in U.S. Pat. No. 4,001,857 there are described devices wherein a film on a spool is processed in situ in a film cassette. In practice a film processed in such devices is processed very unevenly with very poor results. In U.S. Pat. No. 4,134,666 there is described a film processing system in which a film is transferred from a cassette to a spool which can be withdrawn into a light-tight enclosure. This enclosure can then be positioned over a plurality of processing baths and the film lowered into each bath. This system is complex to use and requires several pieces of equipment. In U.S. Pat. No. 4,171,055 there is described a complex and expensive device for removing a film on a spool from a cassette. Such a device could be used when a film is to be wound onto the normal spiral developing tank.

It is an object of the invention to provide apparatus for the processing of a film which is simple and easy to use.

According to the present invention there is provided apparatus for the processing of a film contained in a cassette, the cassette being of the kind comprising a substantially cylindrical body formed with a light-tight, longitudinally extending film exit slot, end caps to said body and a spool held between said end caps and having the film wound thereon, characterised in that the apparatus comprises a light-tight enclosure provided with means shaped to receive and retain said cassette body and provided with a space sufficiently large to receive from said cassette the spool with the film wound thereon, and a plunger for engaging the spool of said cassette and movable to force an end cap off the cassette body and to move said spool and the film wound thereon out of the cassette body and into said space, said space being intended to contain liquid for processing the film.

The present apparatus may be used for the daylight unloading of cassettes into a processing space which is not bulky and although the apparatus does not comprise a spiral member for holding the film, good processing results can be obtained by use of the apparatus.

Preferably the enclosure comprises a columnar body made of a light-opaque material for accommodating a centrally apertured block to receive the cassette and retain the cassette body and for defining said space below the block. The block has a central hole through which the lower end cap of the cassette and the cassette spool having a film wound thereon can pass but which comprises at least one axial slot closed at its lowermost end and which is so shaped that the lipped film exit slot of the cassette fits therein, the cassette retaining means being so located in the columnar body that there is below it sufficient space to accommodate the spool bearing the coiled film. In one embodiment, a lid to render the apparatus light-tight is placed on the columnar body, the lid bearing a plunger the end of which is adapted to engage the uppermost end of the spool in the cassette. The application to the plunger of a screwing action forces off the lowermost end cap from the cassette sidewalls, and further depression of the plunger into the columnar body causes the spool bearing the wound film to leave the cassette retaining means and to be received in the space therebelow. Processing liquid can be provided in this space and the film and/or the processing liquid is agitated in the space to cause the liquid to flow over the surface of the film.

The liquid can be provided in the space below the cassette retaining block by placing liquid in this space before the cassette is inserted in the cassette retaining block or by introducing it therein afterwards. This may be accomplished by providing the apparatus with light-tight channels and/or passages for introducing processing liquid into said space and removing it therefrom. To this end the apparatus may have the channels or passages formed in a lid or base plate or by providing a tube above the liquid space which goes through the side wall of the container.

The liquid-receiving space below the cassette body retaining means holds enough liquid to process the film but the volume of liquid required is usually much smaller than the volume required in most processing drums which comprise a spiral.

In one embodiment of the present apparatus and as implied above, no provision is made for filling the apparatus with liquid or removing liquid therefrom after the cassette has been placed therein. In this embodiment processing liquid has to be placed in the liquid container space before the cassette is placed in the apparatus.

However, in another and preferred embodiment of the apparatus, means are provided in the lid for pouring liquid into the apparatus and for removing it from the apparatus (by inverting the apparatus) through the same means, such means comprising a light labyrinth.

In yet another and also preferred embodiment, means are provided in the base of the liquid container space for allowing liquid to enter this space when the apparatus is placed in a container of processing liquid. The processing step is carried out whilst the apparatus is in the processing bath. When the processing step is completed the apparatus is lifted out of the bath and the liquid flows out of the apparatus. Again such liquid entrance and exit means comprise a light labyrinth.

Preferably the base plate of the liquid container space is so shaped to accommodate the lower-most end cap centrally when forced off the cassette. Also preferably the base plate is so shaped to provide bearing support to the hub end of the spool to facilitate the rotation of the spool as the film is coiled and uncoiled thereon during processing.

The body of the cassette cannot pass through the cassette retaining means because the axial slot in which the lipped exit slot of the cassette is located prevents this.

As the coiled film on the spool leaves the cassette it becomes only loosely coiled and processing liquid is able to act over the whole surface of the film.

In nearly all 35 mm. film cassettes now being produced, one end of the spool on which the film is wound protrudes substantially through one end cap of the cassette (long hub end of spool). Most preferably it is this end cap which is forced off and means are provided to prevent the cassette being inserted in the device so that the other end cap through which the spool does not protrude is the lowermost end cap. Preferably this is achieved by not allowing the lid to be placed on the columnar body to render it light tight if the spool protrudes out of the upper-most end cap. Most usually this means that the lid cannot be screwed down on the columnar body if the spool is protruding through the upper-most end cap.

In one embodiment of the present apparatus, the cassette body retaining block is so formed that is exerts a compressive grip on the cassette body as well as supporting it by the mouthpiece. This may be achieved by forming the block in two halves or employing an axially split cylinder. The cassette is fitted into such a block and forced into the columnar body. This design of cassette body retaining block provides maximum support for the cassette body which is of particular importance with staked end caps.

Preferably the end of the plunger is so designed that it readily engages the end of the spool in the cassette and subsequently retains it by virtue of an interference fit achieved by slight compression of the plunger tip. Thus when the lower-most end cap is forced off the cassette the spool is still retained on the plunger. Rotation of the plunger causes the coil of film on the spool to circulate in the liquid in the bottom of the liquid container space.

Preferably there is present in the base of the liquid-receiving space means to engage a sprocket hole in the coiled film. Most preferably the plunger when fully extended into the space can be rotated in both directions and comprises an internal clutch so that it cannot be rotated beyond a limiting restraining force.

Thus when a sprocket hole has been engaged by the engaging means in the bottom of the space, the plunger can be rotated so tending to coil up the film until the engaging means in the sprocket hole acts to restrain further coiling of the film. The plunger may then be rotated in the contra-direction to uncoil the film until the film retaining means on the spool acts to prevent further uncoiling of the film. Thus the clutch prevents the film from reverse coiling in either direction.

The rotation of the plunger first in one direction and then in the other provides a means for circulating the processing solution in the liquid-receiving space very evenly over the whole of the coil of film. Thus when the film is in the space which is filled with processing liquid and a sprocket hole is engaged, rotation of the plunger first in one direction and then in the other direction causes the film on the spool to coil and then uncoil and causes considerable agitation of the liquid in the space, whereby fresh processing solution is continuously pumped over the entire surface of the film in the space.

Automatic means may be connected to the other end of the plunger, that is to say the end of the plunger to which the spool is not attached, to cause the plunger to rotate first in one direction and then in the other direction until the processing step is complete.

Preferably the sprocket hole retaining means is a spike present in the lower end of the liquid container space. Preferably the columnar body below the cassette retaining means is so shaped that when the coiled film on the spool is caused to enter the liquid space its leading edge is fanned out to ensure that a sprocket hole engages with the spike.

In a preferred embodiment, the apparatus comprises a lid which is adapted to be screwed down on to the columnar body. Preferably in this case the plunger is interference fitted on to the end of the spool in the cassette and the lid then screwed down on to the columnar body. In this position the plunger is rigidly fixed in the lid and the screwing action causes the plunger to rotate in the direction to coil the film on the spool. When the lower-most end cap has been forced off the cassette, the plunger still holding the spool with the film thereon passes through the cassette for a sufficient distance to enable the lower-most spool end to locate in the bottom of the liquid space.

The plunger is then free to rotate in both directions. However, during the time the film on the spool is being forced out of the cassette it is important that a continuous screwing action in the correct direction of rotation only is applied to the top-most end spool end to prevent the coiled film from rubbing the walls of the cassette and perhaps being scratched or deformed thereby.

Figure 2:
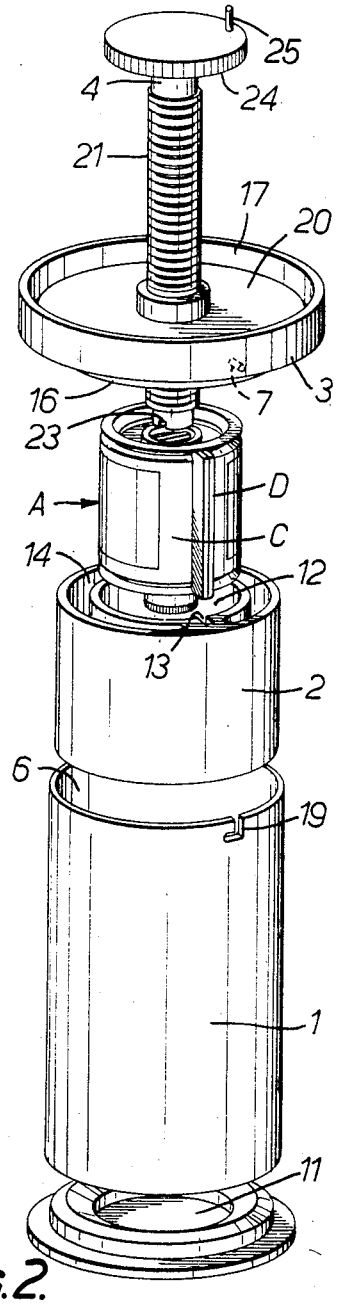
Figure 3:
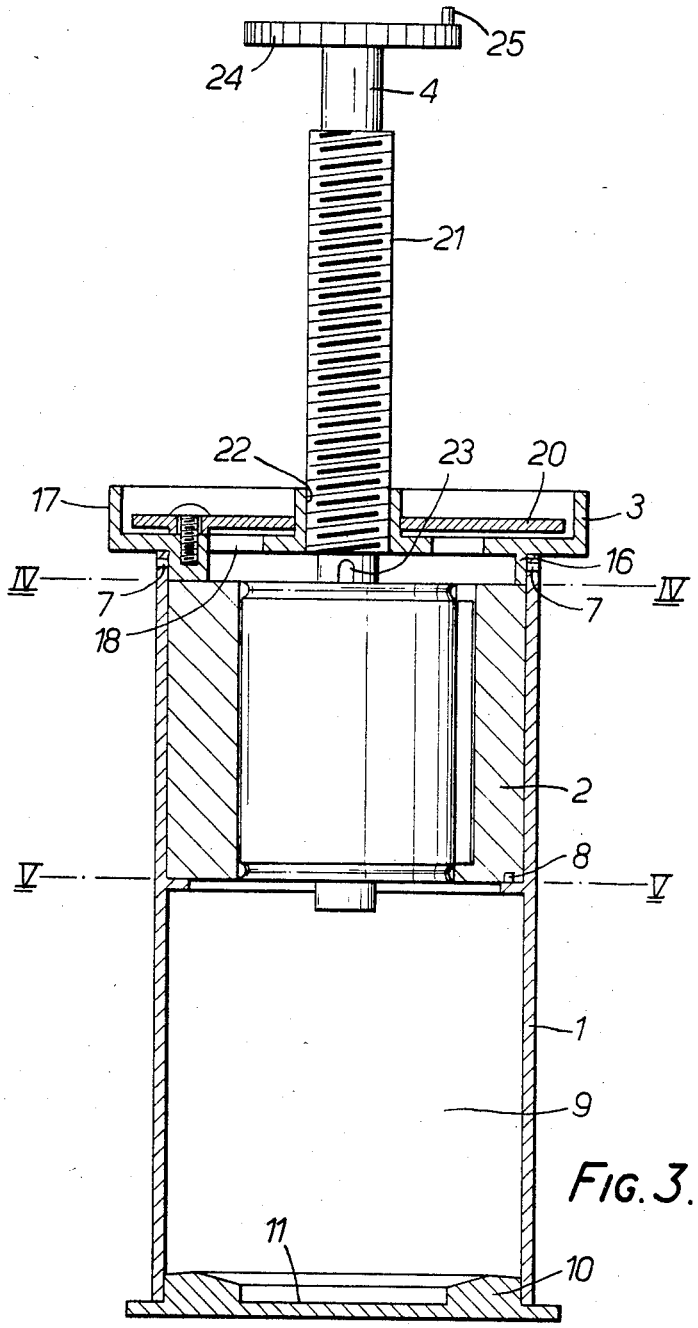
Figure 4:
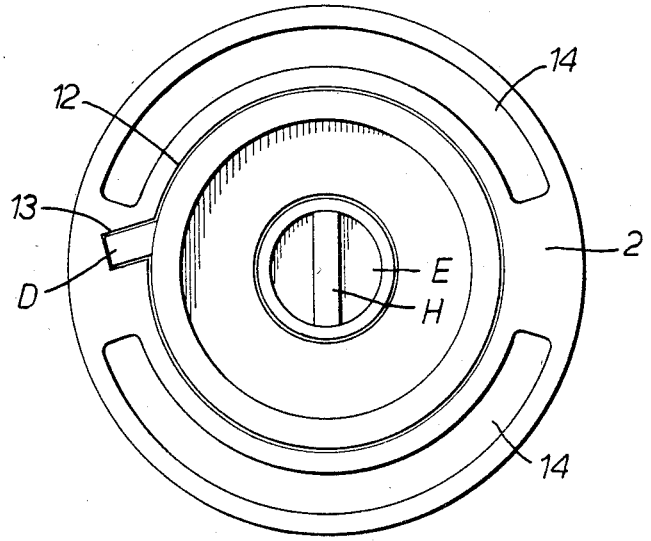
Figure 5:
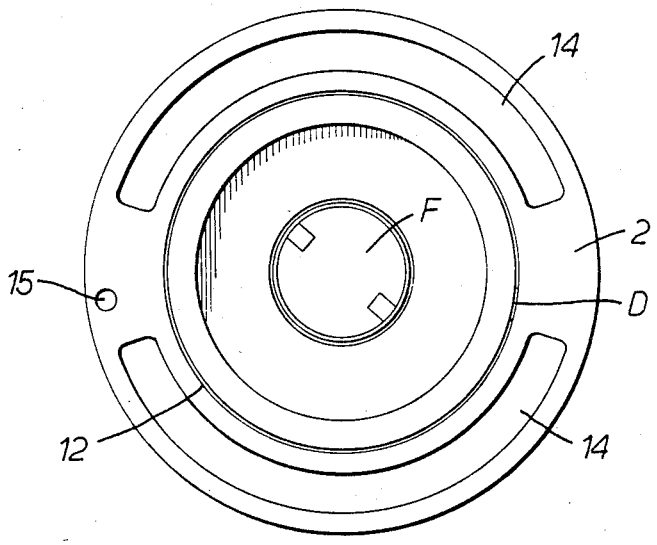
Figure 6:
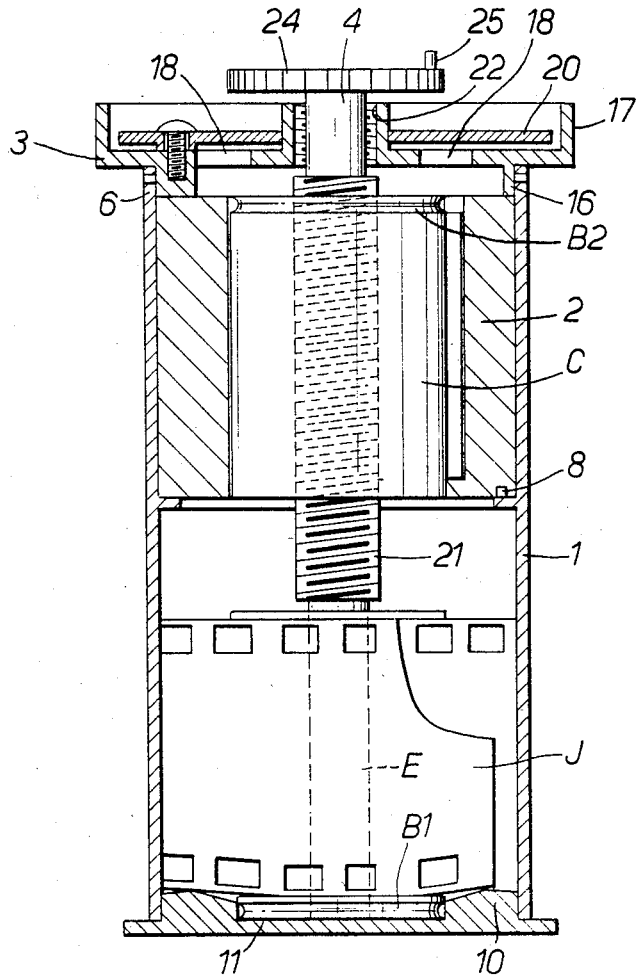
Figure 7:
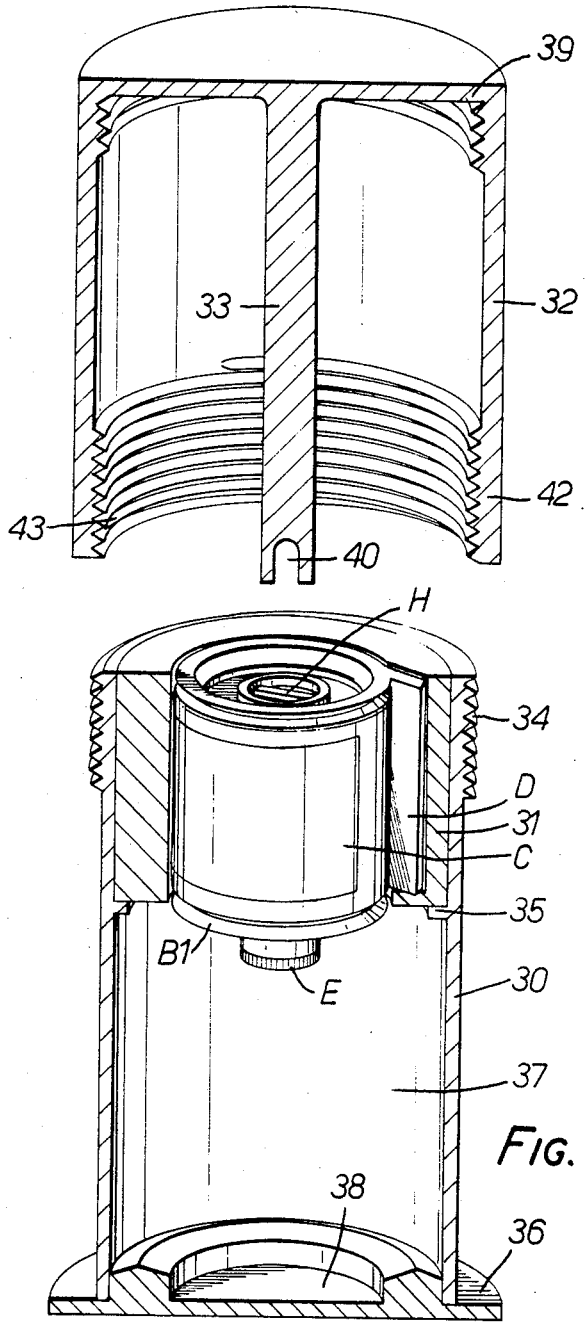
Figure 8:
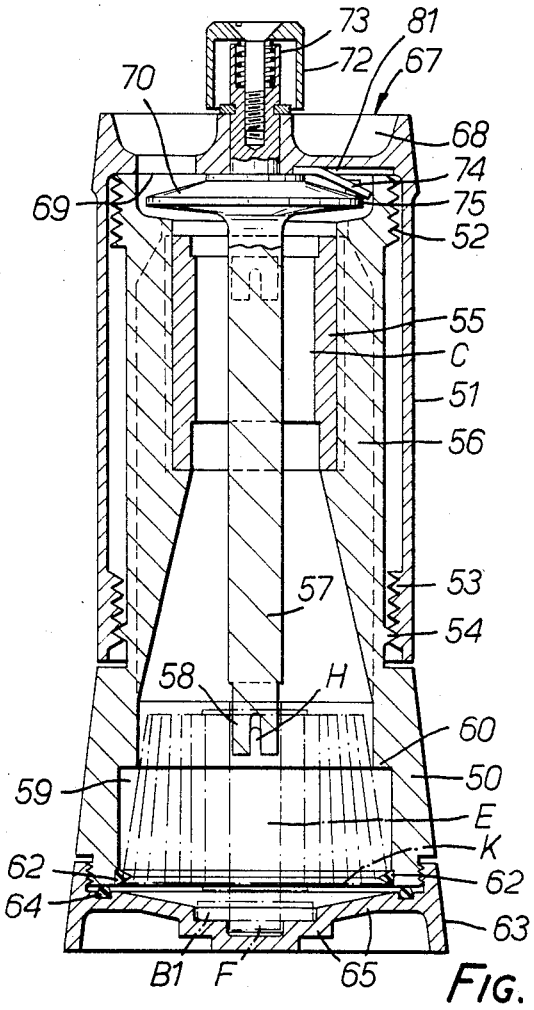
Figure 9:
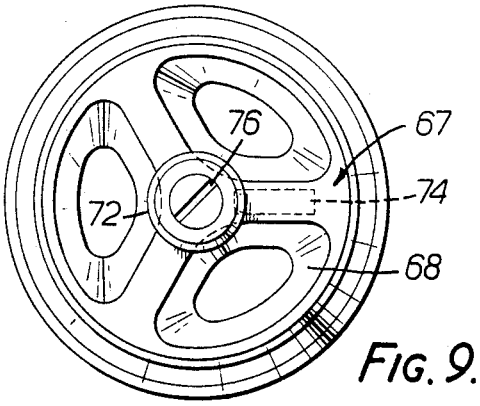
Figure 10:
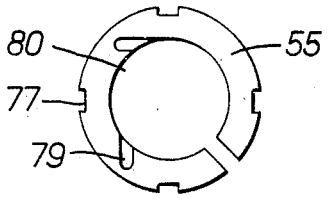

In order to enable the invention to be more readily understood, reference will now be made to the accompanying drawings, which illustrate diagrammatically and by way of example some embodiments thereof, and in which FIG. 1 is an exploded view of a 35 mm. film cassette loaded with a length of film, FIG. 2 is an exploded view of a processing apparatus according to the present invention, FIG. 3 is a cross-sectional side elevation of the assembled apparatus of FIG. 2, FIG. 4 is a horizontal sectional view of a retaining block of the apparatus taken along the line IV—IV of FIG. 3, FIG. 5 is a horizontal sectional view of the retaining block taken along the line V—V of FIG. 3, FIG. 6 is a cross-sectional side elevation similar to FIG. 3 but showing the apparatus in use in developing a film in processing liquid in the bottom of the apparatus, FIG. 7 is a perspective cross-sectional view of another apparatus according to the present invention, FIG. 8 is a cross-sectional side elevation of yet another apparatus according to the present invention, FIG. 9 is a horizontal top view of the apparatus of FIG. 8, FIG. 10 is a top plan view of a cassette retaining block shown in FIG. 8.

Figure 11:
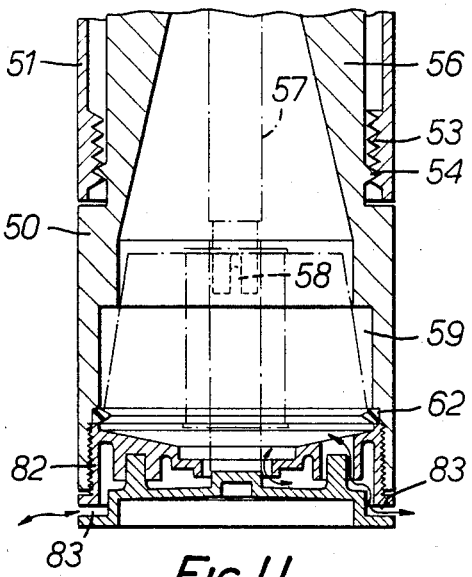
Figure 12:
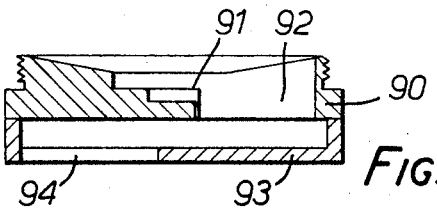

FIG. 11 is a cross-sectional side elevation of the bottom half of a similar apparatus to that shown in FIG. 8, but with a different liquid charging and discharging means, and FIG. 12 is a cross-sectional side elevation of yet another different liquid charging and discharging means.

The same parts of the cassette shown in FIG. 1 retain the same designation in all the Figures.

In FIGS. 2 to 6 the same reference numbers have the same signification, and in FIGS. 8 to 11 the same reference numbers have the same signification.

Referring now to FIG. 1 there is shown a normal 35 mm. film cassette which comprises two annular end caps B1 and B2 and a substantially cylindrical cassette body C having a light-tight, longitudinally extending film exit slot D which is formed by pinching together the two ends of a metal strip from which the cassette body C is formed. The cassette body is intended to hold film J wound on to a flanged spool E which has a long hub end F and short hub end G. Located inwards of the end G and extending diametrically across the end is an axial member H by use of which, in a camera, the film is wound either on to the spool or from the spool past the exposure chamber. The film J has a leading edge K and conventional sprocket holes L.

In FIGS. 2 to 6 there is shown a processing apparatus which comprises three main parts, namely a columnar body 1, a cassette body retaining block 2 and a light-tight lid 3 having connected thereto a plunger 4. The cassette is also shown and marked A. The body 1 and the lid 3 are made of light-opaque plastics material.

The columnar body 1 has an open end 6 formed with two diametrically opposed bayonet slots 18 intended to receive pegs 7 on the lid 3, whereby the lid may be secured to the body. The body 1 comprises an internal flange formed with an upwardly directed peg 8 which is used to secure in position the cassette body retaining block 2. Below the internal flange is a space 9 which is intended to hold processing liquid. The end of the body 1 is closed by a removable base plate 10 which has built into it a recess 11 into which, in operation, the end cap B1 of the cassette falls.

The cassette body retaining block 2 is an annular cylindrical member with a central cylindrical hole 12 into which the loaded cassette fits. The lower end of the retaining block 2 is formed with a hole 15 (c.f. FIG. 5) into which the peg 8 in the body 1 fits to locate the retaining block 2 in the body 1. An axially extending slot 13 opens into the cylindrical hole 12 and serves to receive the lipped film exit slot D of the film cassette A when the loaded cassette is fitted into the hole 12, the slot 13, however, being blocked at its lower end as shown in the drawings. The retaining block 2 is formed with two arcuate slots 14 which are arranged diametrically opposite one another and extend through the block in the axial direction thereof.

The lid 3 has a dished upper end 17 formed with holes 18 covered by a light-excluding disc 20 which is secured to the lid by screws in such a way that it is spaced a short distance above the lid to provide a fluid pathway to the holes 18 around the periphery of the disc 20.

Mounted in the lid 3 is a plunger 4 having an external screw thread 21 which screws down through an internal screw thread 22 in the lid 3. At the end of the plunger 4 is a slot 23 which fits over the axial member H in the end of the spool E.

The other end of the plunger 4 carries a wheel 24 having a turning handle 25 mounted thereon.

FIGS. 4 and 5 show how a cassette A fits into the cylindrical hole 12 of the block 2 whilst the film exit slot D of the cassette fits into slot 13 of the block 2, which slot, as shown in FIG. 5, is closed at the lower end of the block.

In operation of the processing apparatus just described, the cassette body retaining block 2 is placed in the open end 6 of the columnar body 1. An exposed length of film J in the cassette A is wound so that it is entirely within the cassette and the cassette is then inserted into the cylindrical hole 12 so that the film exit slot D is retained in the slot 13 of the block 2. The cassette is placed so that the long hub end F of the spool faces downwards.

The lid 3 is then fitted on the body 1 by placing the slot 23 on the plunger 4 over the axial member H in the spool E and adjusting the screw mechanism so that the lower portion 16 of the lid fits into the open end 6 of the body 1. The bayonet fitting is then actuated by inserting the lid 3 on the body 1 to engage the pegs 7 in the slots 19, and this renders the apparatus light-tight.

The apparatus is then held steady on a flat surface and handle 25 is held and the wheel 24 is rotated. This causes the plunger 4 to screw down into the body 1 exerting a force on the spool E and in turn on the cassette end cap B1.

A few turns of the wheel 24 cause the lower end cap B1 of the cassette A to be forced off the end walls of the cassette and fall to the bottom of the body into the recess 11. Further turning of the wheel 24 causes the plunger to take the spool E having the film J wound thereon down through the body of the cassette C and into the space 9 of the body 1. The length of screwed travel of the plunger 4 is such that the plunger stops when the protruding end F of the spool just locates in the end cap B1 in the recess 11.

This leaves the body of the cassette C with the end cap B2 still attached in the cylindrical hole 12 in the cassette retaining block 2. The cassette body C is not pushed through the block 2 by the plunger 4 because the fact that the slot 13 is closed at its lower end prevents the film exit slot D which is attached to the cassette body C from passing through the block 2.

As shown in FIG. 6 the film J expands to become loosely coiled as the spool E and the film wound thereon enter the space 9.

The whole process of loading the cassette A into the apparatus and actuation of the plunger 4 to force the spool having the film wound on it into the space 9 can take place in full daylight as the film itself is shielded from the light either by being present in the cassette or by being contained within the light-opaque enclosure constituted by the columnar body 1 and by the base plate 10 and lid 3, both of which are light tight.

Processing of the exposed film can now commence. A measured volume of processing liquid is poured into the dished end 17 of the lid and flows under the light-excluding disc 20 and down through the holes 18 and the holes 14 in the block 2 into the space 9 in the body 1. Sufficient liquid is added to immerse the film J completely in the liquid. The wheel 24 is then caused to rotate first in one direction and then in the other direction to cause agitation of the film in the liquid to ensure even processing of the film throughout its length.

After the requisite period of time, the apparatus is inverted and the used processing liquid flows out of the holes 18. Another processing liquid or if desired water can be added to the apparatus either further to process the film or to wash it.

In practice a monobath processing solution which comprises both a developing agent and a fixing agent may be used. In this case, the apparatus is inverted and the removable base 10 is removed so that the film can be water washed in the apparatus. Alternatively a developing solution may be used first, followed by a fixing solution and thereafter the film is washed in the apparatus.

FIG. 7 shows another apparatus according to the present invention which comprises a columnar body 30, a cassette body retaining block 31 and a lid 32 which comprises an internally mounted plunger 33.

The columnar body 30 has an open end bearing an external screw thread 34 and an internal flange or shelf 35 on which the retaining block 31 can rest.

Below the shelf 35 is the liquid-receiving space 37 of the body 30. At the base of the liquid-receiving space 37 is a removable base plate 36 having a recess 38 into which the end cap of the cassette can fall.

The retaining block 31 is similar to the retaining block 2 of FIGS. 1 to 6 and comprises a hollow centre into which the cassette body C fits and a slot leading off the hollow centre into which the exit slot D of the cassette A fits.

The lid 32 comprises a closed end 39 on to which the plunger 33 is fitted, the plunger 33 having a slotted end 40 which fits over the axial member H in the spool E of the cassette A.

The lid 32 also comprises an open end 42 having an internal screw 43 which mates with the external screw 34 in the tubular body 30.

The columnar body 30 and the lid 32 are both composed of a light-opaque plastics material.

In the operation of the apparatus shown in FIG. 7, a pre-determined volume of solution is poured into the liquid container portion 37 of the body 30 and the cassette body retaining block 31 is then placed in the body 30.

A cassette A containing an exposed film is then placed in the hollow centre of the block 31 so that the film exit slot D is held in the slot which opens off the hollow centre.

The slotted end 40 of the plunger 33 is fitted over the axial member H in spool B and the lid 32 is screwed down on the body 30 by means of the mating screw threads 34 and 43. After a few turns of the lid 31 on the body 30 the end cap B1 will be forced off the cassette body C and will fall into the recess 38. Continued screwing down of the lid 32 on the body 30 will cause the threads to become disengaged. This allows the lid to be pushed down so that the plunger 33 pushes the spool having the film J wound thereon into volume of liquid in the space 37 of the body. This downwards movement of the plunger is carried out rapidly to ensure that all the film is immersed in the liquid as nearly as possible at the same time. This is important if a monobath is being used. Agitation of the liquid over the film can be achieved by shaking the device and or by inverting and re-inverting the apparatus at predetermined time intervals.

The apparatus of FIG. 7 is a particularly simple apparatus which is cheaper and easier to operate than the apparatus of FIGS. 2 to 6 but it is suitable only for use with a monobath processing solution. However by use of the apparatus of FIGS. 2 to 6 it is easy to obtain very even development of the film as well as complete fixing.

FIG. 8 shows a modification of the apparatus shown in FIGS. 2 to 6. The apparatus of FIG. 8 comprises a columnar body 50 on to which is fitted a hollow cylindrical lid 51 formed at its open end with an interior screw thread 53 which is adapted to mate with an upper screw thread 52 on the exterior of the body 50 and, after it has been screwed down past the screw thread 52, to mate with a lower screw thread 54 on the exterior of the body 50. A cassette retaining block 55 is held in position in the body 50 by radial vanes 56.

A plunger 57 is attached to the lid 51 and has a resilient forked end 58 which fits over the axial member H in the spool E so as to form an interference fit on the member H so that the spool is retained on the end of the plunger 57 after the spool has been pushed out of the cassette body C, which is retained in the block 55.

The vanes 56 are shown to form a fluted array so enabling the film coiled on the spool to uncoil slightly as the spool is pushed out of the cassette body C.

Located in the body 50 below the fluted vanes 56 is the liquid-receiving space 59. The body 50 is formed with a step 60 which encroaches into the space 59 and which aids in fanning out of the leading edge K of the film J. Located towards the bottom of the liquid-receiving space 59 are two spikes 62. These locate in the sprocket holes L of the film J and the fanning out of the leading edge of the film ensures that the sprocket holes in the outermost coil of the film only are engaged by the spikes 62.

The space 59 is closed by a removable base plate 63 which is sealed by an 'O' ring 64. The base plate 63 is shaped with steps 65 to receive the pushed-off end cap B1 through the central hole of which the hub end F of the spool protrudes and to ensure that the pushed off end cap B1 comes to rest as shown in FIG. 8.

The lid 51 has on its upper surface 67 three cavities 68 each of which as shown in FIG. 9, has a hole 69 at its bottom communicating with the inside of the body 50. A light baffle is provided by a flange 70 which is present on the plunger 57 and which prevents light from entering the body 50 via the holes 69. Thus liquid can be poured via the cavities 68 and the holes 69 to fall through the body 50 via the cassette retaining block 55 into the liquid container 59, but no light is able to enter the apparatus because of the flange 70.

Connected to the end of the plunger 57 remote from the split end 58 is a plunger rotating knob 72 which is mounted on the plunger 57 by a clutch 73.

Attached to the underside of the upper surface 67 of the lid is a resilient abutment member 74 which normally extends obliquely downwards from the interior of the lid so as to obtrude into the path of a pin 75 extending upwardly from the flange 70 as shown in the inset to FIG. 9 thereby to lock the lid and plunger in rotation.

FIG. 10 is a top plan view of the cassette retaining block 55 and it will be seen that the block 55 is in effect a split cylinder. Located around the exterior of the block are four axial slots 77 into which the vanes 56 fit.

Also shown in this Figure is the shape of slots required for the lipped film exit slot D. Slot 79 is the shape of slot required of an off-set cassette of the type shown in FIG. 1. Slot 80 is the shape of slot required for a tangential cassette. Both slots 79 and 80 are present in the block 55 so that the apparatus can be used either for off-set cassettes or for tangential cassettes.

The method of operation is very similar to that described in connection with the apparatus of FIGS. 2 to 6.

Thus in this case the end of an exposed film is wound fully into the cassette and the cassette is placed in the cassette retaining block 55 utilising the correct slot depending upon whether the cassette is an off-set or tangential cassette.

The block 55 is then pressed into the body 50 of the apparatus so that the vanes 56 fit into the axial slots 77 and compress the block 55. (With the slots 79 and 80 arranged as shown in FIG. 10 it is impossible to fit the cassette with its protruding hub end uppermost.)

The forked end 58 of the plunger is then fitted over the axial member H of the spool in the cassette to form an interference fit. Lid 51 is then screwed on to the body 50 by the mating sets of screw threads 52 and 53. Initially the plunger and the lid are locked in rotation by the engagement of the abutment member 74 with the pin 75. However, as the lid is screwed down, the abutment member engages the upper end of the columnar body 50 and is pressed into a recess 81 in the underside of the lid where it is displaced from the path of movement of the pin 75 thus allowing the plunger to be rotated by the knob 72 under the control of the clutch 73. Thus when the lid 51 is screwed down on to the body 50 the plunger 57 acts on the spool in the cassette forcing off the end cap B1. When the end cap is forced off the mating sets of screw threads continue to mesh until the coiled film leaves the cassette body C. Then the lid 51 is slid down the body 50 until the screw threads 53 on the lid mesh with the lower set of screw threads 54 on the body 50 and serve to stabilise the lid 51 on the body 50.

When the threads 53 and 54 engage, the plunger 57 is fully extended and carries on its forked end 58 the spool of coiled film, the leading edge K of which has started to fan out. Also as mentioned above, the pin 75 has been disengaged from the abutment member 74 which is raised out of contact therewith. This enables the clutch mechanism 73 to come into operation and enables the plunger rotating knob 72 to be rotated in either direction so rotating the plunger 57 to which the coiled film is attached.

The plunger 57 is then rotated until the sprocket holes K are engaged by the spikes 62. The clutch has an overriding function so that once the edge of the film has been secured by the spikes, further uncoiling of the film is prevented and the film is prevented from becoming coiled in the opposite sense. However, rotation of the plunger in the opposite direction enables the film to be coiled up until the force exerted by the spikes causes the clutch to prevent further rotation in this direction.

Thus the clutch allows the film on the spool to be coiled and uncoiled to a limited extent.

When the film has been positioned at the bottom of the body 50 a requisite quantity of processing liquid is poured into the liquid-receiving space 59 of the body 50 via the holes 69, the amount of liquid being sufficient to cover the whole film on the spool. At once the plunger is caused to rotate first in one direction and then in the other direction, thus causing the film on the spool to coil and uncoil. This movement of the film in the liquid pumps the liquid round the liquid container and ensures good agitation of the liquid over the surface of the film. This ensures very even processing of the film. After sufficient time for the processing step to be completed, the apparatus is inverted and the liquid emptied out of the apparatus via the holes 69.

Another processing liquid can then be poured into the apparatus via the holes 69 and the plunger rotated as before to ensure even processing. Finally if required wash water can be poured into the apparatus.

After the last lot of liquid has been emptied out of the apparatus, the base plate 63 is removed from the body 50 of the apparatus and the spool of film can then be removed from the apparatus.

A further modification to the apparatus of the present invention is shown in FIGS. 11 and 12.

The apparatus shown in FIG. 11 is exactly the same as the apparatus shown in FIG. 8 except that a different removable base plate for the liquid-receiving space is employed. In this case the base plate 82 comprises a complex labyrinth system of holes and light baffles 83. These are so arranged that when the apparatus of FIG. 11 is placed in a liquid bath liquid is able to enter the liquid-receiving space 59 to the height of the liquid in the bath. When the apparatus is lifted out of the bath all the liquid in the space 59 flows out of the container, the liquid flow paths being indicated by the arrows in FIG. 11.

Thus is operation a cassette is loaded into the apparatus and the film on the spool is pushed out of the cassette as described in connection with the apparatus of FIGS. 8 to 10. Then instead of pouring liquid via the holes 69 into the liquid-receiving space 59, the apparatus is stood in a bath of processing liquid which contains a sufficient depth of liquid to cover the film on the spool in the liquid container.

The liquid then enters the liquid container space 59 to this depth. In this case the flange 70 and holes 69 act as light-shielded air vents.

The plunger is then rotated first in one direction and then in the other direction as is done with the apparatus of FIGS. 8 to 10.

After the processing step has been completed, the apparatus is lifted out of the processing bath and the liquid empties out of the liquid container space 59 via the holes 83.

When all the liquid has stopped flowing out of the apparatus, the apparatus can be stood in another bath of different processing liquid and the process repeated.

In a further embodiment of the apparatus shown in FIG. 11 a different removable base plate formed with a labyrinth system of communicating passages and light baffles is provided, and is shown in FIG. 12.

In FIG. 12 the removable base plate 90 comprises a stepped cap receiving area 91 which leads to a cavity 92. Thus when the end cap B1 falls into the receiving area 91 it can then be directed into the cavity 92 by tilting the apparatus. Further tilting of the apparatus in the other direction then causes the end cap to slide along a base 93 of the base plate 90 until it reaches slot 94 from which it falls out of the apparatus. The apparatus can then be stood in a bath of processing liquid and the processing liquid then enters the apparatus via the slot 94 which is light shielded by the underside of the cap receiving area 91. After processing is complete, the apparatus is lifted out of the bath and liquid leaves the apparatus via the slot 94.

If desired a mechanical oscillating or rotating device can be fitted to the plunger rotating knob of the apparatus of FIGS. 8 to 12 since mechanical movement of the plunger can provide convenient and effective agitation of the film in the liquid-receiving space 59.

We claim:

1. An apparatus for the processing of a film contained in a cassette, the cassette being of the kind comprising a substantially cylindrical body formed with protruding light-tight, longitudinally extending film exit slot means, end caps to said body and a spool held between said end caps and having the film wound thereon, said apparatus comprising a light-tight enclosure, means therein shaped to receive and retain said cassette body and having a space sufficiently large to receive from said cassette the spool with the film wound thereon, and a plunger adapted for engaging the spool of said cassette and being movable to force one of said end caps off said cassette body and to move said spool and the film wound thereon out of said cassette body and into said space, said space being adapted for containing liquid for processing the film.

2. The apparatus of claim 1, wherein said enclosure comprises a clumnar body, having a longitudinal axis, and a block accomodated by said columnar body and having a central aperture adapted for receiving the cassette and retaining the cassette body and for limiting said space below said block at an upper end zone thereof.

3. The apparatus of claim 2, wherein said central aperture of said block extends longitudinally, with an adjoining, axially extending groove or recess adapted for receiving said protruding film exit slot means of the cassette, said groove or recess having a blocked lower end.

4. The apparatus of claim 1, wherein said enclosure comprises a lid and said plunger is so mounted in axially screwable relation in said lid as to be fitted into said spool and, when screwed downward, to force off the lowermost end cap of the cassette and pass through the cassette body to move the spool having the film wound thereon into said space underneath said block.

5. The apparatus of claim 4, wherein each said lid and said block comprises at least one channel for introducing processing liquid into said space and for removing it therefrom, with at least either the channel of said lid or of said block, or both, being light-tight.

6. The apparatus of claim 5, wherein the said lid has a threaded aperture through which said plunger passes.

7. The apparatus of claim 5, wherein said plunger is fixed to said lid or integral therewith, and said lid comprises a screw-threaded attachment to the remainder of said enclosure.

8. The apparatus of claim 2, wherein said plunger is rotatable about said longitudinal axis, thereby enabling the spool to be rotated in said space.

9. The apparatus of claim 8, wherein said plunger comprises clutch means adapted for preventing continued rotation of the plunger after it has encountered a predetermined resistance to turning movement.

10. The apparatus of claim 5, wherein said space is shaped to permit a leading edge of the film to fan out after the spool carrying said film has been moved out of said cassette body and downwardly into said space.

11. The apparatus of claim 11, wherein said film has sprocket holes and said block comprises engaging means adapted for engaging a sprocket hole of said film.

12. The apparatus of claim 11, wherein said engaging means is a spike protruding into said space and adapted for engaging a sprocket hole in a leading edge of said film.

13. The apparatus of claim 1, wherein said means for receiving the cassette is adapted for exerting a compressive grip on the body of the cassette.

14. The apparatus of claim 13, wherein said means for receiving the cassette is a split cylinder.

15. The apparatus of claim 1, wherein said means for receiving the cassette has a central, longitudinally extending aperture adapted for receiving said body of the cassette, and two adjoining parallel, longitudinally extending slots, being closed at their lower ends, one of said parallel slots being shaped to accomodate the protruding film exit slot of an off-set cassette and the other being shaped to accomodate the protruding film exit slot of a tangential cassette.

16. The apparatus of claim 2, wherein said columnar body comprises a removable base permitting access to said space.

17. The apparatus of claim 2, wherein said base comprises light labyrinth means for allowing liquid to enter and leave said space, and a light labyrinth air vent in the top of the enclosure.

18. The apparatus of claim 17, wherein said light labyrinth means in said base is so constructed that an end cap of the cassette which falls to the bottom of the space can be removed from the apparatus through said last-mentioned light labyrinth means.

* * * * *